US005162606A

United States Patent [19]

Jacob

[11] Patent Number: 5,162,606

[45] Date of Patent: Nov. 10, 1992

[54] MODULAR BLASTING SYSTEM

[75] Inventor: Merritt Jacob, Allentown, Pa.

[73] Assignee: Atlas Powder Company, Dallas, Tex.

[21] Appl. No.: 789,621

[22] Filed: Nov. 8, 1991

Related U.S. Application Data

[63] Continuation of Ser. No. 507,739, Apr. 12, 1990, abandoned.

[51] Int. Cl.[5] ..... F42B 3/10; C06C 5/00

[52] U.S. Cl. ..... 102/301; 102/275.5; 102/275.7; 102/275.9; 102/275.11; 102/275.12

[58] Field of Search ..... 102/275.1, 275.2, 275.3, 102/275.4, 275.5, 275.7, 312, 314, 318, 301, 275.11, 275.12

[56] References Cited

U.S. PATENT DOCUMENTS

| | | | |
|---|---|---|---|
| 481,012 | 8/1892 | Doyle | 102/275.1 |
| 927,968 | 7/1909 | Harle | 102/275.4 |
| 1,025,065 | 4/1912 | Ingram | 102/275.5 |
| 1,298,418 | 3/1919 | Stokes | 102/275.5 |
| 1,598,920 | 9/1926 | Mallet | 102/275.4 |
| 1,698,962 | 1/1929 | Olin et al. | 102/202.12 |
| 1,719,065 | 7/1929 | Mallet | 102/275.4 |
| 1,887,122 | 11/1932 | Duffy | 102/275.7 |
| 1,991,857 | 2/1935 | Lewis | 102/275.7 |
| 2,171,384 | 8/1939 | Young | 102/318 |
| 2,401,641 | 6/1946 | Hill | 102/314 |
| 2,586,541 | 2/1952 | Horn et al. | 102/318 |
| 2,654,077 | 9/1953 | McLoad | 439/624 |
| 2,858,764 | 11/1958 | Hesson et al. | 102/312 |
| 2,952,206 | 9/1960 | Beckstead | 102/275.7 |
| 3,175,491 | 3/1965 | Robertson | 102/275.7 |
| 3,349,706 | 10/1967 | Schaumann | 102/275.7 |
| 3,431,849 | 3/1969 | Kern et al. | 102/318 |
| 3,590,739 | 7/1971 | Persson | 102/275.5 |
| 3,669,021 | 6/1972 | Spencer et al. | 102/275.2 |
| 3,706,277 | 12/1972 | Willard et al. | 102/275.7 |
| 3,709,149 | 1/1973 | Driscoll | 102/312 |
| 3,713,384 | 1/1973 | Turnbull | 102/275.7 |
| 3,878,785 | 4/1975 | Lundborg | 102/275.4 |
| 3,987,732 | 10/1976 | Spraggs et al. | 102/275.7 |
| 3,987,733 | 10/1976 | Spraggs et al. | 102/275.3 |
| 4,248,152 | 2/1981 | Yunan | 102/275.4 |
| 4,350,097 | 9/1982 | Bowman et al. | 102/275.2 |
| 4,714,018 | 12/1987 | Lofgren | 102/275.7 |
| 4,770,097 | 9/1988 | Wilson et al. | 102/312 |
| 4,771,694 | 9/1988 | Bartholomew et al. | 102/275.7 |
| 4,815,382 | 3/1989 | Yunan | 102/275.7 |
| 4,821,645 | 4/1989 | Reiss | 102/275.3 |
| 4,953,464 | 9/1990 | Reiss | 102/312 |
| 4,989,516 | 2/1991 | Silvia | 102/275.2 |
| 4,998,478 | 3/1991 | Beck | 102/275.7 |

*Primary Examiner*—David H. Brown
*Attorney, Agent, or Firm*—Richards, Medlock & Andrews

[57] ABSTRACT

Modular components including donor units (20), relay units (30), and detonator units (50) create a variety of blasting systems. A donor unit (20) is formed from a signal transmission tube (22) having donor mini-caps (24) attached to each end thereof. A relay unit (30) is a device having a receptacle (32) at one end to receive a donor mini-cap in operative association and engaging means (34) to operatively engage a point along another donor unit such that the detonator contained within the relay unit (30) will initiate the transmission lines passing through the donor unit. A detonator unit (50) is provided for the initiation of explosives such as boosters and primers and comprises a shell for receiving explosives and a receptacle at one end suitable for receiving a donor mini-cap (24) at the other end. Relay units (30) allow for the simultaneous initiation of several donor units. Each donor unit can be attached to either additional relay units or to detonator units (50). Detonators can instantaneously explode or be fitted with delay elements. Thus, complex detonation patterns can be constructed with relatively few, easily assembled modular components.

20 Claims, 4 Drawing Sheets

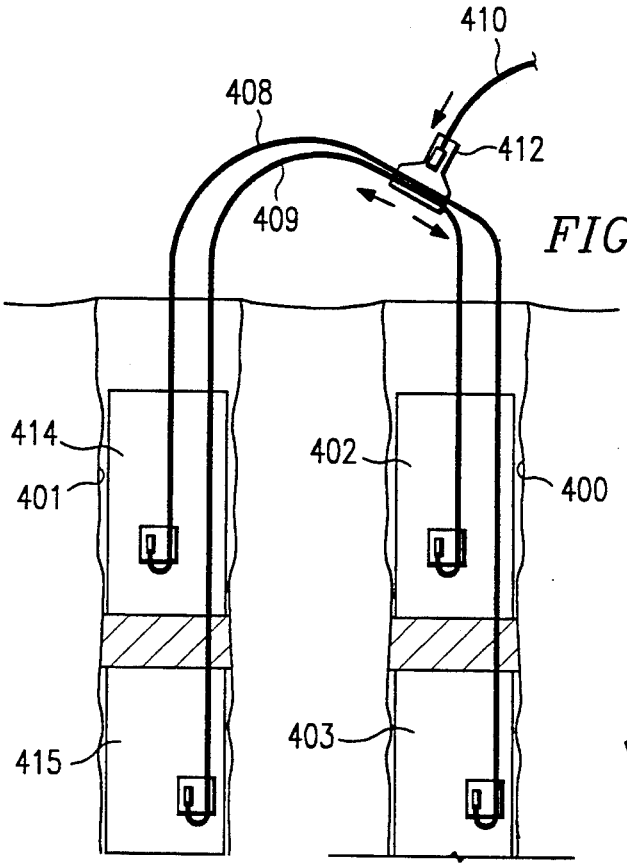
FIG. 10
FIG. 9
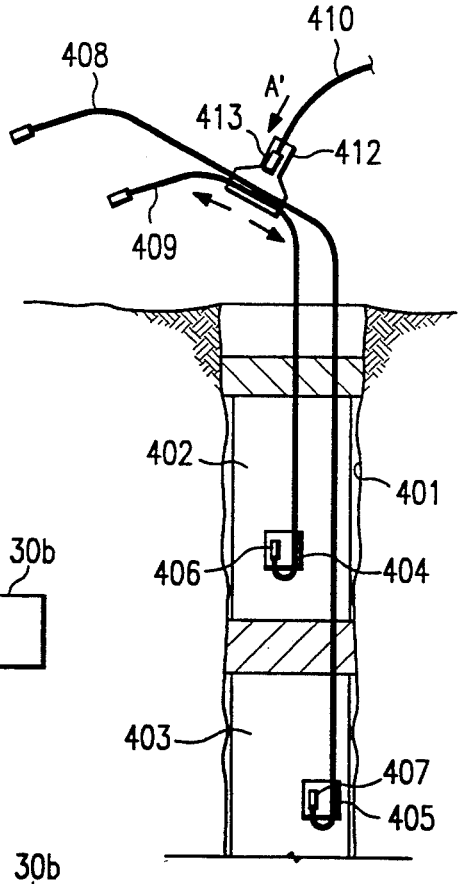
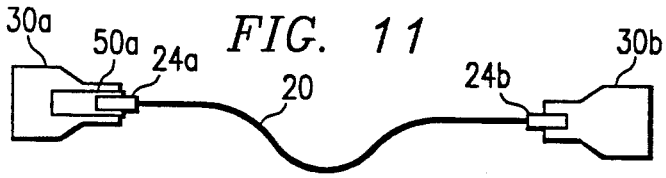
FIG. 11
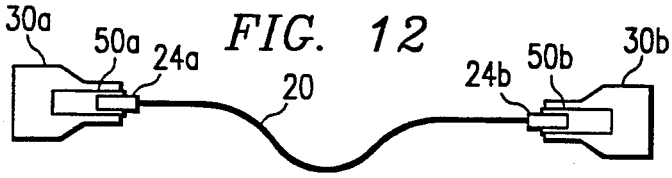
FIG. 12

MODULAR BLASTING SYSTEM

This application is a continuation of U.S. patent application Ser. No. 507,739 filed Apr. 12, 1990, now abandoned.

TECHNICAL FIELD

The present invention relates to explosives and to components and systems useful in the detonation of explosives. In particular, the invention relates to modular components from which a system for transmitting a detonation signal can be constructed to achieve a predetermined detonation pattern.

BACKGROUND OF THE INVENTION

In blasting operations, various devices are used to transmit a blast signal from a remote initiation location to explosives in a borehole. These devices include detonating cord, safety fuses, energy transmission tubes, blasting caps and various connectors arranged in such a manner as to detonate explosives in a desired sequence and pattern. In nonelectric systems, delay elements may be interposed along signal transmission lines on the surface or in the boreholes to achieve sequential initiation of explosive charges.

In a typical arrangement, trunklines carry the blast signal from an initiator to downlines or to surface delay devices. Both trunklines and downlines are lengths of detonating cord or other signal transmitting devices. The trunkline is the portion of the transmission line on the surface, connecting boreholes. A downline is connected to a trunkline and extends into a borehole. The downline transmits the signal from the trunkline or surface delay element to the explosive in the borehole. The downline may also be attached to delay devices in the boreholes and/or to instantaneous blasting caps in the borehole.

The use of delay devices to detonate explosives in a predesigned pattern at predetermined times can be useful to achieve the desired breakage of rock. This is particularly true when the explosives within a borehole are "decked", that is, loaded in explosive sections that are detonated at different times. Delay devices also help to reduce the noise and vibration common to blasting operations which is important in light of governmental regulations and complaints from nearby residents. Due to these advantages, the industry has made wider use of delay devices.

To provide different delay periods downhole and to accommodate holes of varying lengths, it has been common practice to place a desired delay element on one end of a single transmission device. Typically a series of signal transmission tubing lengths are provided for each delay. For example, a 25 millisecond delay cap may be attached to various lengths of single transmission tubing, e.g., 10 feet, 15 feet, 20 feet and 25 feet. Unfortunately, this requires a large inventory of both different delay elements and different lengths of transmission tubing.

There is a continuing need to provide a reliable, simple, yet versatile system which will allow connection of explosive charges in a pattern. The present modular system has the advantage of providing a system which is easy to use while permitting easy variation of blasting patterns. The present invention also permits a substantial reduction in inventory by accommodating a great variety of combinations from a few elements. The present system also has the advantage that the signal tubing can function as both the downline and the trunkline. Further, the system can be utilized to provide multiple pathways for detonation signals between boreholes, thus increasing reliability of detonation.

SUMMARY OF THE INVENTION

The present invention utilizes the bi-directional capability of signal transmission tubes along with the following modular units: a surface relay unit, a donor unit, and a detonator unit. Each modular unit will delay the propagation of an initiation signal a distinct and known amount of time. The modular system permits greater versatility in operation because time delays may be easily varied by exchanging surface relay units for detonator units. For example, two surface relay units may be attached to each end of the donor unit. In another embodiment, a surface relay unit and a detonator unit may be attached to each end of a donor unit. In yet another embodiment, two detonator units may be attached to each end of a donor unit. Thus, a system can be constructed in which the combination of a donor unit with relay units and detonator units may be assembled to achieve a number of different purposes and a wide variety of delay periods.

The donor unit is comprised of a length of signal transmission line to which donor mini-caps are affixed at each end. The transmission line is preferably a tube containing a reactive material which propagates a signal by generation of a plasma front within the tube. These transmission lines can be initiated at varying locations along their length. Upon initiation of the signal transmission line, the signal will be transmitted to each end of the transmission line from the point of initiation. The signals then initiate the donor mini-caps located at each end of the signal transmission line. The donor mini-caps are capable of initiating the relay unit and the detonator unit, but are incapable of initiating the midpoint of another transmission line and preferably are not capable of initiating the transmission line to which they are attached.

The donor mini-cap, or cap used in blasting, represents another novel aspect of the present invention. Each mini-cap is comprised of a shell having a thin bottom portion which will blow out upon initiation of the explosive contained within the mini-cap. The explosive is placed at the bottom of the cap. Provided above the explosive charge is a reduced diameter section leading into an empty chamber which at the other end has a second reduced diameter section. Above the second reduced diameter section is a section of sufficient diameter to receive signal transmission tubing into operative association with the mini-cap. Preferably, the mini-cap explosive charge contains a desensitizing agent to reduce sensitivity to shock initiation. For example, a composition containing from about 15% to 35% clay, the remainder being explosive material, is suitable for use in the mini-cap.

The relay unit comprises a block containing a detonator unit. The block is constructed so as to allow a donor mini-cap to be held by the block or the detonator or both in operative association with the detonator element of the block. The block is also provided with a second receptacle for allowing the detonator to be in operative association with one or more transmission lines at any point along the lines lengths. The detonator element in the relay unit may be an instantaneous detonator or a delay detonator of desired delay.

Another aspect of the present invention is a detonator which may be assembled with a donor mini-cap. The detonator is comprised of a wall defining a shell having a first and second end. The first end is open and the second end is closed. Located at the second end is an explosive charge which will provide in-hole initiation of a primer with which it is associated. The explosive charge is also of sufficient strength to initiate a signal transmission line when both the line and the detonator are in operative engagement with a relay unit. The explosive charge is initiated by the detonation of the donor mini-cap attached to said detonator. Above the explosive charge is a delay element for providing either an instantaneous initiation or a predetermined delay for initiation. Adjacent the delay element is an ignition transmission element. Adjacent the ignition transmission element is a reduced diameter section containing a primer, the reduced diameter section being dimensioned such that it will ignite the primer upon detonation of the reduced diameter section. Adjacent a second reduced diameter section, the wall is dimensioned to receive a donor mini-cap and is provided with connecting means to connect the donor mini-cap with the detonator. The connector means may be a screw thread or a series of deflectable ridges to provide a frictional fit.

By combining the units, a modular blasting system is created comprising a donor unit having a relay element of desired time delay connected to one end of the donor unit and a detonator unit attached to the other end of the donor unit. In another embodiment, a blasting system is provided in which a donor unit has a detonator unit attached to each end. In yet another embodiment, the donor unit has a relay unit connected to each end.

BRIEF DESCRIPTION OF THE DRAWINGS

A more complete understanding of the invention may be had by reference to the following detailed description when taken in conjunction with the accompanying drawings wherein like referenced characters denote like parts in all views and wherein:

FIGS. 8–10 schematically illustrate modular components used to achieve decking in a borehole; and FIGS. 11 and 12 illustrate additional configurations of the modular blasting system.

DETAILED DESCRIPTION OF THE INVENTION

The present invention provides a signal transmission system using modular components which offers unique versatility and can also provide multiple signal paths. Using this system, a blasting pattern can be arranged such that a proper blasting sequence, including delays, is maintained. The invention also provides relay units, initiator units, and donor units that may be used in the system to achieve bi-directional and multi-directional signal transmission within a blast pattern.

Figure 1:
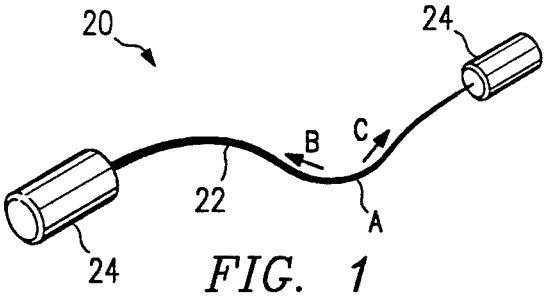
FIG. 1 is a perspective view of a donor unit.

FIG. 1 illustrates a donor unit generally indicated as 20. The unit comprises a length of signal transmission line 22 which has attached to each end a donor mini-cap 24 or cap used in blasting. The signal transmission line 22 has such characteristics that when initiated at some point along its length, such as point A in FIG. 1, a detonation signal will be transmitted to each end of the unit from point A as indicated by arrows B and C. When the signal reaches each of the donor mini-caps, it detonates the donor mini-caps. The signal transmission line may be any suitable signal transmission line which will propagate a signal reliably in both directions when it is initiated at a point along its length. Suitable signal transmission lines are illustrated in Janoski U.S. Pat. No. 4,290,366, the disclosure of which is hereby incorporated by reference. The hollow tube contains a reactive material such that a detonation signal is transmitted along the tube by oxidation and the creation of a plasma front. A similar transmission line is also disclosed in Persson U.S. Pat. No. 3,590,739, the disclosure of which is hereby also incorporated by reference. Importantly, these signal transmission lines can transmit a signal in either direction along the length of the line. Other suitable transmission lines may be used.

Figure 2:
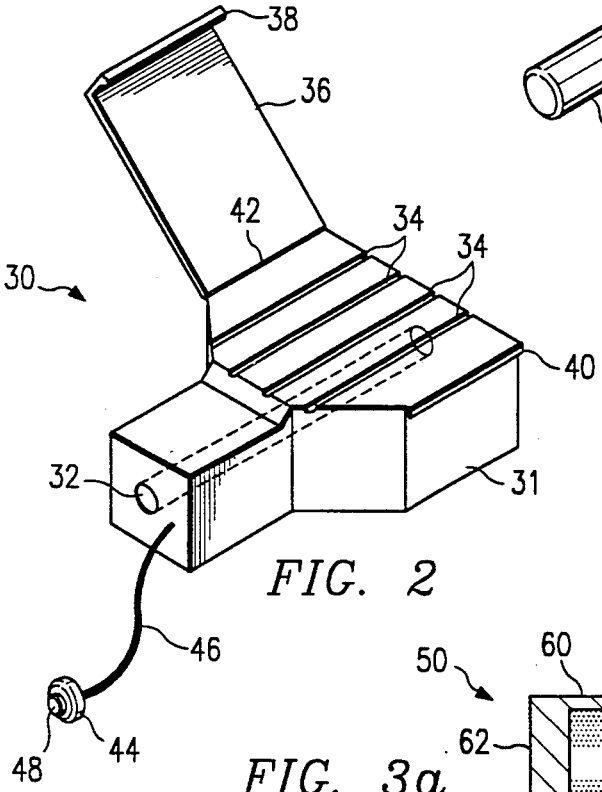
FIG. 2 is a perspective view of a relay unit.

FIG. 2 is a perspective view of the relay unit 30. The relay unit comprises a body 31 defining a passageway 32 for receiving the detonator unit generally shown in FIGS. 3*a*–3*c*. The relay element is also provided with a means for receiving other transmission lines in operative relationship with the detonator element. These are comprised of grooves 34. A means to hold or lock the inserted transmission lines is provided such as a cover 36 on one side of the relay unit block which utilizes a lip 38 extending from the cover 36 dimensioned to engage a cooperating ridge 40 on the opposite side of the relay unit body 31. The cover 36 is preferably hingedly connected at hinge 42 which may be flexible plastic. It is also possible to provide a cover which snaps onto the body as a separate piece or other appropriate mechanisms. The element also preferably includes plug 44 which is attached to the relay unit body 31 by flexible strand 46. The plug 44 is dimensioned with a raised portion 48 which provides frictional fit into passageway 32. The purpose of plug 44 is to prevent dirt and other debris from entering the passageway prior to assembly of the unit.

Preferably, the relay unit body is made from a plastic material having a density of about 0.94 g/cc or higher. Such material has been found to effectively permit transmission of a detonation signal from a detonator element which is placed in passageway 32 to transmission lines in grooves 34. The distance between the detonator and the transmission lines is close enough that initiation of the detonator is sufficient to initiate the transmission lines. Usually, the thickness to the body between passageway 32 and grooves 34 is less than about 0.030 inches. Preferably the relay units are made of a high-impact plastic such as HDPE or 25%/75% HDPE/LDPE and are color coded to reflect the millisecond delay housed within each. Color coding facilitates the correct placement of the units in the blast pattern.

Figure 3A:
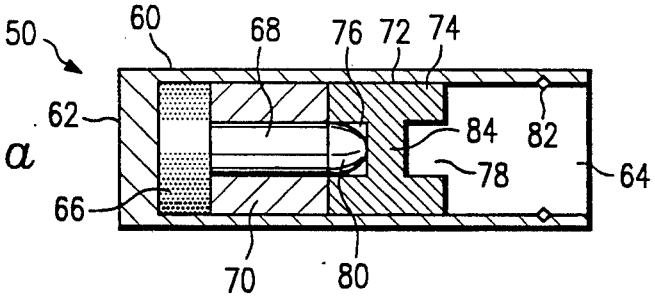
FIG. 3*a* is a sectional view of a detonator element to be placed in a relay element.

FIG. 3*a* illustrates the detonator element 50 which is either placed in passageway 32 of relay element 30 or used alone. The overall dimensions of the detonator are those used currently in the art for caps. It is constructed of a generally cylindrical body 60 having a closed end 62 and an open end 64. Generally, the detonator is about 0.270 inches to about 0.300 inches in diameter and about two to four inches in length. Adjacent to the closed end is explosive charge 66. Adjacent to the other side of explosive charge 66 is delay element 68 which is a length of pyrotechnic having a controlled burning rate which typically is contained within a cylindrical body 70 which engages the interior wall of body 60. Adjacent to the delay element 68 and cylindrical body 70 is a percussion ignition primer element ("PIPE") 72. The PIPE 72 is comprised of a ferrule 74 having an H-shaped cross section. Ferrule 74 engages the walls of the body 60 and provides two smaller channels 76 and 78. In channel 76, operably adjacent to ferrule 74, is primer 80. Primer 80 is optional, as ferrule 75 can be designed with an extremely thin mid-section 84 which acts as a protective diaphragm or flyer plate.

Disposed close to open end 64 are thread surfaces 82. These surfaces interact with the donor mini-caps 24 of the donor unit 20 (shown in FIG. 1) to hold the donor mini-cap in operative association with the detonator element 50. In operation, initiation of the donor mini-cap results in a deflection of the narrow mid-section 84 of the H-shaped ferrule 74. This deflection then causes primer 80 to ignite. Ferrule 74 can be made of aluminum or plastic and the thickness of the mid-section 84 should be less than or equal to 0.015 inches. If no primer is used, mid-section 84 should be between 0.005 to 0.010 inches thick. Ignition of primer 80 causes delay element 68 to burn which after a predetermined delay, causes explosive element 66 to detonate. The detonation of explosive element 66 is of sufficient strength to transmit the blast signals to signal transmission lines in grooves 34 of the relay unit body 31.

Figure 3B:
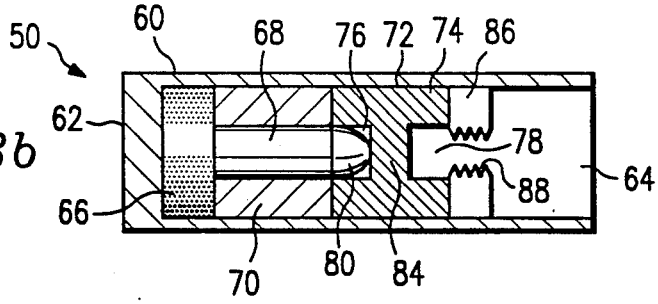
FIG. 3*b* is a sectional view of another embodiment of the detonator element utilizing a plug engagement means.

FIG. 3*b* shows yet another construction of the detonator element 50 in which the same numbers as utilized in FIG. 3*a* are used to point out similar elements. However, in this embodiment, no thread surfaces 82 are provided. In contrast, an engaging means is provided by plug 86 which is cylindrical in shape and operates by engaging the inner surfaces of body 60. The interior passageway through the plug 86 is provided with resilient protrusions 88. These protrusions 88 are dimensioned to engage in frictional fit a protrusion on the donor mini-cap of the donor unit and function to hold the donor mini-cap in operable relationship with the detonator element 50. Preferably, protrusions 88 are dimensioned so that they are flexible in the direction towards closed end 62 and resist flexing in the direction of open end 64. This design allows relatively easy insertion of the donor mini-cap but yet resists separation of the donor mini-cap from the detonator element. The functioning of the detonator of FIG. 3*b* is similar to that as described for the detonator of FIG. 3*a*.

Figure 3C:
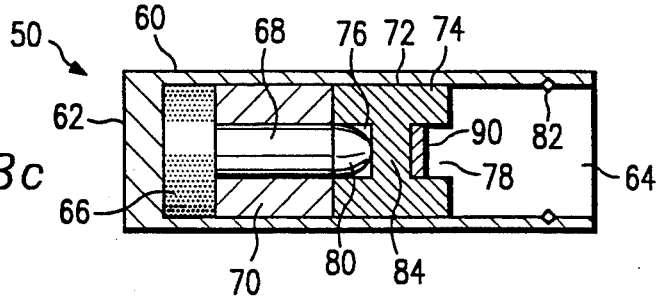
FIG. 3*c* is a sectional view of the detonator element of FIG. 3*a* with a deforming charge added.

Again, in FIG. 3*c* similar numerals are utilized for reference to similar elements. The embodiment in FIG. 3*c* differs from the embodiment in FIG. 3*a* in that a deforming charge 90 is provided. The function of the deforming charge 90 is to boost the detonation signal received from the donor mini-cap and to assist in deformation of mid-section 84 such that primer 80 is ignited. When the deforming charge is used the thickness of the midsection of the ferrule may be increased to about 0.030 inches. The delay element 68 in the detonator unit 50 may be constructed such that it is either instantaneous or provides a predetermined delay period such as 18, 42, or 100 milliseconds.

Figure 4:
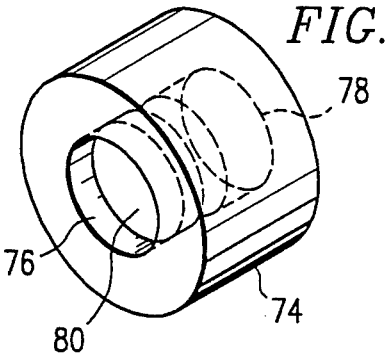
FIG. 4 is a perspective view of a ferrule.

FIG. 4 is a perspective view of ferrule 74 showing the cylindrical channel 76 and the cylindrical channel 78. Primer element 80 is shown in phantom.

Figure 5A:
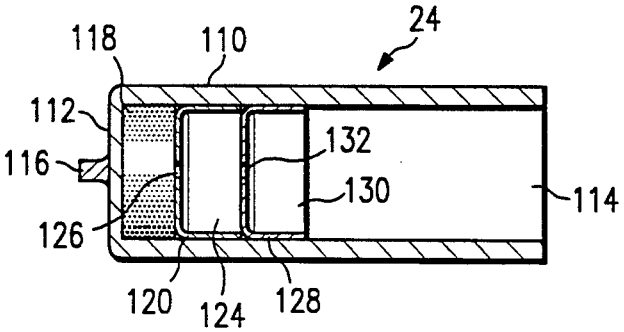
FIG. 5*a* is a sectional view of a donor mini-cap.

FIG. 5*a* illustrates one construction of the donor mini-cap 24. The donor mini-cap 24 or cap used in blasting has a cylindrical wall 110 which is closed at one end 112 and has an open end 114. Protruding from the closed end 112 is striker pin 116. Adjacent to the closed end 112 and contained within the body 110 is explosive element 118. Explosive element 118 is preferably a composition with some resistance to shock. The incorporation of about 15–35% clay, with the remainder of the charge made from explosive materials known suitable for blasting caps, has been found very effective. A suitable clay is bentonite. Adjacent to the other side of the explosive element 118 is cup element 120 having a cylindrical wall which defines a large "blow-back" preventing passageway 124 and a smaller detonation transmission passageway 126. Adjacent to cup 120 is receiving cup 128 which engages body 110. Cup 128 has a cylindrical body which defines a transmission line engaging passageway 130 and a smaller signal transmission passageway 132.

Cup 120 and detonation transmission passageway 126 discourage any "blow-back" to the transmission line 212 from the accidental ignition of explosive element 118. Hence, the transmission line 22 could not be initiated by accident. The dimension of the cup 120 can vary depending on the size of the charge 118 in the mini-cap 24. For a charge of about 100 to about 200 milligrams of diazodinitrophenol and clay, of which about 75% is diazodinitrophenol, a cup element with a height of about 0.625 inches and an inside diameter of about 0.228 inches is appropriate. Further, the detonation transmission passageway 126 is approximately 0.80 inches in diameter. This design could also be employed for normal strength explosive elements. The "blow-back" preventing passageway 126 can also include a series of baffles or shock absorbing material.

Figure 5B:
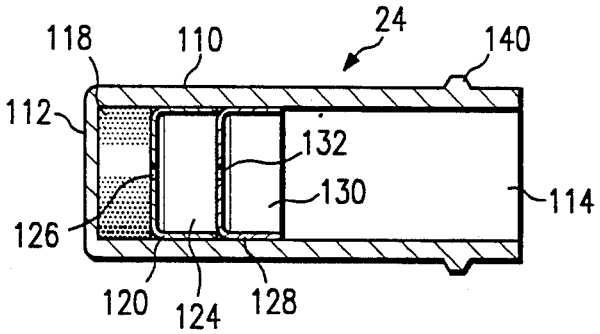
FIG. 5*b* is a sectional view of an alternative embodiment of the donor mini-cap.

FIG. 5*b* shows an alternate embodiment of the donor mini-cap 24 in which like reference numbers are utilized for like elements. In addition, extending from body 110 is thread surface 140. Thread element 140 is dimensioned to engage thread groove 82 on detonators equipped with thread grooves (see FIGS. 3*a* and 3*c*). Note that in this embodiment the striker pin 116 is not utilized.

Figure 5C:
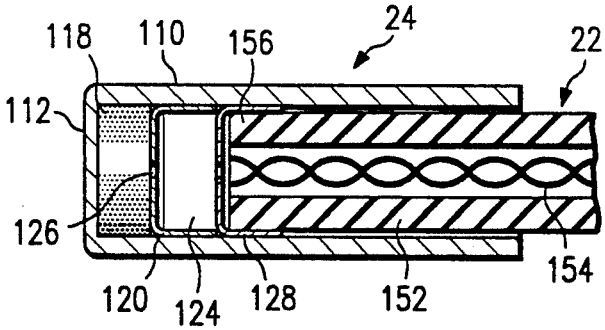
FIG. 5*c* is a sectional view of the mini-cap attached to a signal transmission line.

FIG. 5*c* illustrates the donor mini-cap 24 attached to signal transmission line 22 which has a tubular wall 152 and contains within the tubular wall reactive strands 154 or other reactive material. Construction of the tubular wall 152 is detailed in Janoski U.S. Pat. No. 4,290,366, and the signal transmission tube illustrated in Persson U.S. Pat. No. 3,590,739 may also be used. Referring to FIG. 1, when the donor element 20 is initiated at midpoint A on the signal transmission tube 22 a signal will progress to one or both ends. Similarly, as reactive element 154 initiates it will convey a signal to the end 156 of signal transmission line 22. The signal will pass through passageways 132, 124 and 126 thereby igniting explosive element 118 which will then rupture closed end 112 causing transmission of the signal from the donor mini-cap 24.

Passageways 124 and 126 are dimensioned such that a premature initiation of explosive element 118, for example, by an external shock, will not cause initiation of transmission tube 22. This is a safety feature to prevent premature detonation during connection of the blasting system. Thus, the donor mini-caps are constructed such that they permit the transmission of the detonation signal when it originates at a midpoint on a signal transmission line 22 but prevents initiation of the transmission line 22 in the event of initiation of explosive element 118 by a source other than a signal from signal tube 22. The donor mini-cap illustrated in FIG. 5*a* operates in the same way when attached to a signal transmission line.

Figure 5D:
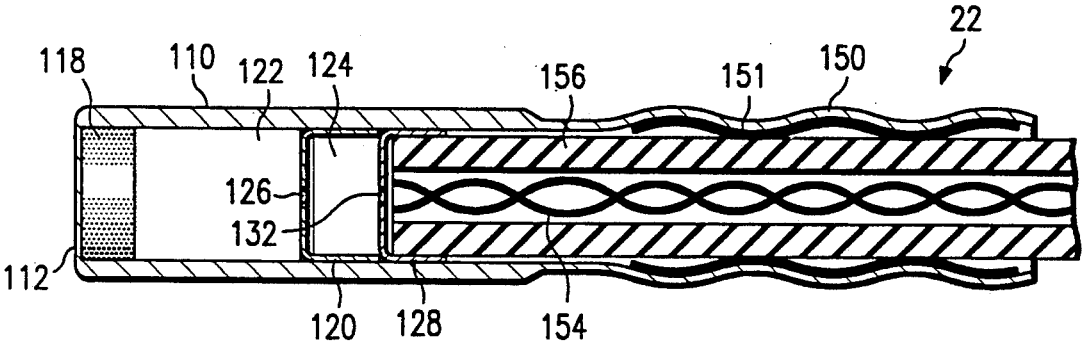
FIG. 5*d* is a sectional view of the transmission signal line in crimped connection with a donor mini-cap.

FIG. 5*d* illustrates a method of attaching donor mini-cap 24 to signal transmission tube 22. Body 110 has a reduced thickness section 150 adjacent to its open end. In operation, signal transmission tube 22 is inserted into the open end of donor mini-cap 24. The reduced thickness section 150 is then crimped to frictionally attach the minicap to the transmission tube. A sealing sleeve 151 provides a water-tight gasket between crimped portion 150 and the transmission tube 22. This embodiment also features void space 122 between explosive charge 118 and cup 120.

Figure 6:
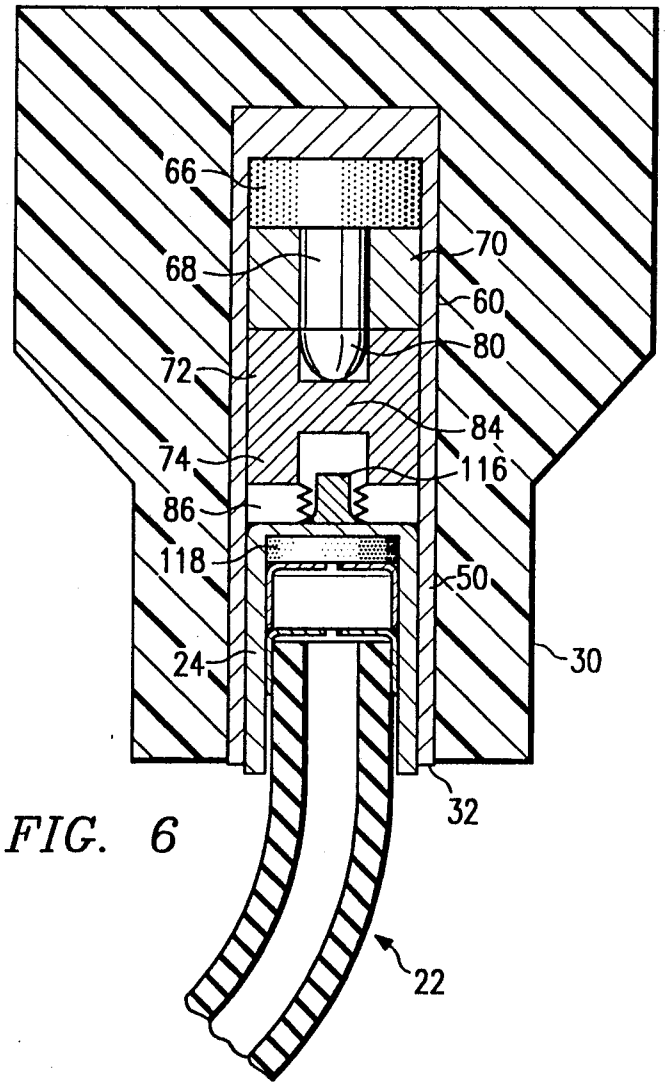
FIG. 6 illustrates the modular components engaged with one another.

FIG. 6 illustrates detonator element 50 engaged in passageway 32 of relay unit 30. The detonator 50 has plug 86 (better shown in FIG. 3*b*) which is dimensioned to engage the striker pin 116 of donor mini-cap 24. The donor mini-cap is held firmly within the detonator. In operation, a detonation signal traveling in signal transmission line 22 ignites the explosive charge 118 of the donor mini-cap. This propels striker 116 into the deflecting portion 84 of ferrule 74 thereby igniting primer 80. The ignition of primer 80 ignites delay element 68 which, after the predetermined delay period, ignites explosive charge 66. The detonation of explosive charge 66 ignites other transmission lines which are engaged with the delay element body 30.

The donor mini-caps of the present invention are constructed such that the relay units and detonator units can easily accept them in a secure manner. The donor mini-caps are also constructed such that they can be easily and securely attached to signal transmission lines. The donor mini-caps are of such strength to initiate the instantaneous or delay element contained within each relay unit or detonator unit in operative association with the donor mini-cap. However, the donor mini-caps are not capable of initiating a signal in a transmission line when placed adjacent to a transmission line.

Figure 7:
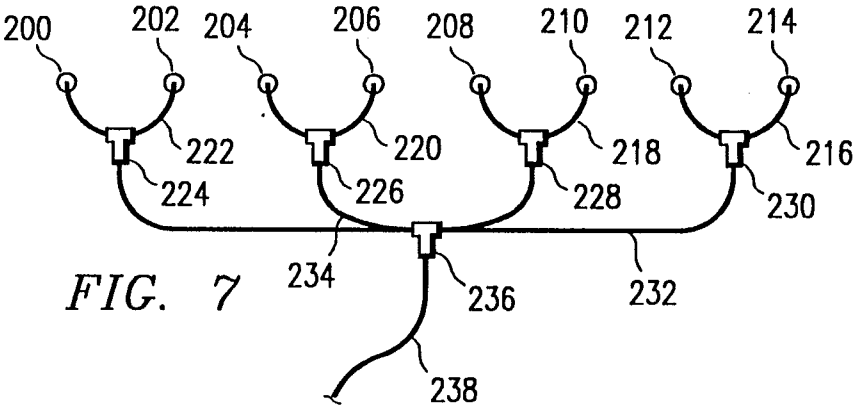
FIG. 7 is a schematic view of a detonation system constructed with various components.

A variety of systems may be designed utilizing the modular components described above. For example, FIG. 7 shows a top view of a borehole pattern having boreholes 200, 202, 204, 206, 208, 210, 212, 214. Leading into the boreholes are downlines which are formed from donor units 222, 220, 218, 216. Attached to each end of these donor units are detonator units 50 (not shown) that initiate explosives contained within the boreholes. Each of the donor units 222, 220, 218, and 216 have connected to them, at a location along their transmission lines, relay units 224, 226, 228 and 230. These relay units receive the donor mini-caps located at each end of donor units 232 and 234 in operative association with the detonators within the relay units. Donor units 232 and 234 have connected at locations along the length of their transmission lines relay unit 236 which in turn is connected in operative association to the donor mini-cap on the end of donor unit 238.

In operation, a detonation signal traveling in donor unit 238 initiates relay unit 236 which in turn initiates donor units 234 and 232 generating signals traveling to both ends of those donor units which, in turn, initiates the donor mini-caps on each end of the units thereby initiating relay units 224, 226, 228 and 230 connected to the donor mini-caps. These initiated relay units, in turn, then initiate donor units 222, 220, 218, and 216 resulting in detonation of the explosives in the borehole.

Figure 8:
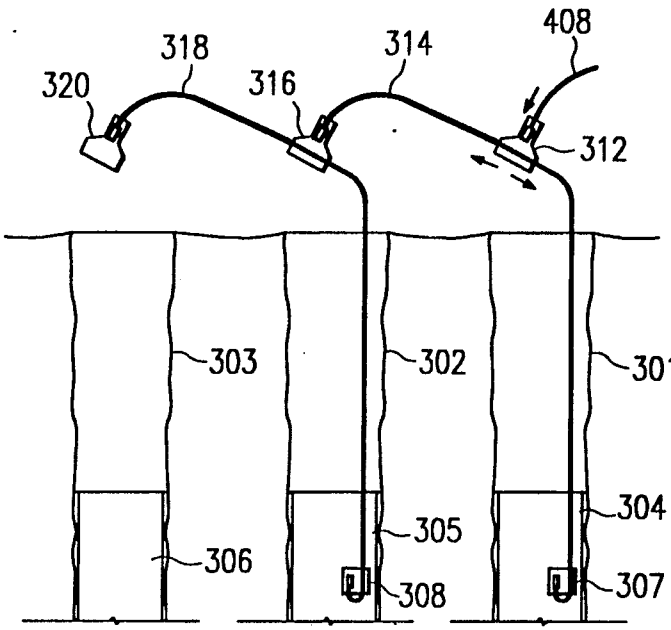

FIG. 8 illustrates another system which may be constructed from the modular components of the present system. Illustrated are a series of boreholes 301, 302 and 303 containing explosive charges 304, 305 and 306. A donor unit 310 connected to an initiation source has a relay unit 312 connected to the donor mini-cap of donor unit 310. A second donor unit 314 is connected to relay unit 312 and the length of it extends into borehole 301. Donor unit 314 has a detonator unit 307 attached to the donor mini-cap at the first end of donor unit 314 and a relay unit 316 attached to the donor mini-cap on the second end of donor unit 314. Attached in operative association with relay unit 316 is a third donor unit 318. Donor unit 31B similarly has a first end extending into borehole 302 and attached in operative association to the first donor mini-cap at the first end is a detonator unit 308. Attached to the donor mini-cap at the second end of donor unit 318 is relay unit 320. Hence, an initiation signal traveling in the transmission line of donor unit 310 will initiate the donor mini-cap at the end of the transmission line which in turn initiates relay unit 312. Relay unit 312 then initiates a detonation signal traveling in both directions within donor unit 314. As a result, detonator 307 on the first end of donor unit 314 is detonated and relay unit 316 is also detonated thereby repeating the process in subsequent units.

FIG. 9 illustrates another use of the modular components to achieve "decking" in a borehole 401. The borehole contains two sections of explosive charges 402 and 403. Depending upon the sensitivity of explosives 402 and 403, they may be initiated either by the detonator unit of the present invention or by a booster which is initiated by the detonator of the present invention. FIG. 9 illustrates the use of two boosters 404 and 405, which receive detonators 406 and 407. The detonators are connected to the donor mini-caps at each end of donor units 408 and 409 which each have a portion extending out of the borehole onto the surface of the blasting area. Connected to the extended portion of donor units 408 and 409 is relay unit 412 which is connected to a donor mini-cap of another donor unit 410.

In operation, a detonation signal travels in the direction of A' which initiates the donor mini-cap 413 which, in turn, initiates a detonator (not shown) in relay element 412. Relay element 412, in turn, initiates donor units 408 and 409, generating a detonation signal in two directions in units 408 and 409 as indicated by the arrows. The four signals initiated by relay unit 412, in turn, initiate the donor mini-caps 406 and 407 at each end of donor units 408 and 409, which initiate detonator units 404 and 405. The decked explosives may be detonated simultaneously by using instantaneous detonator units 406 and 407 or sequentially by using detonators having different time delays elements 68 (as seen in FIGS. 5*a*–5*d*).

FIG. 10 illustrates a variation of the initiation system shown in FIG. 9. Donor units 408 and 409 are used as downlines into boreholes 400 and 401 to explosive decks 402, 403, 414 and 415 within the boreholes. Both donor units 408 and 409 pass through relay unit 412 which is attached to donor unit 410. This illustrates how a single relay unit 412 may be connected to two or more other donor units to form downlines to different boreholes. The desired sequence of detonation of the charges may be controlled by selecting appropriate delay periods.

FIG. 11 illustrates a donor unit 20 with a first donor mini-cap 24*a* and a second donor mini-cap 24*b* at each respective end. Donor mini-cap 24*a* is operatively engaged with detonator 50 which is in turn operatively engaged with relay unit 30*a*. Donor mini-cap 24*b* is operatively engaged with second relay unit 30*b*. FIG. 12 illustrates a donor unit 20 with a first donor mini-cap 24*a* and a second donor mini-cap 24*b*. Each donor mini-cap is operatively engaged to a detonator unit 50*a* and 50*b*, respectively. Each detonator unit 50*a* and 50*b* is then operatively engaged with relay units 30*a* and 30*b*, respectively.

Having described specific embodiments of the present invention, it will be understood that modification thereof may be suggested to those skilled in the art, and it is intended to cover all such modifications as fall within the scope of the appended claims.

I claim:

1. A modular blasting system for use in blasting operations comprising:

(a) a donor unit comprising:

(i) a transmission line with a first end and a second end; and (ii) a donor mini-cap attached to each end of said transmission line;

(b) a relay unit operably engaged to the first end of said donor unit; and (c) a detonator unit operably engaged to the second end.

2. The modular blasting system of claim 1 wherein said relay unit is further engaged to at least one additional donor unit.

3. The modular blasting system of claim 1 wherein said detonator unit is further engaged to a second relay unit.

4. A modular blasting system for use in blasting operations comprising:

(a) a donor unit comprising:

(i) a transmission line with a first end and a second end; and (ii) a donor mini-cap attached to each end of said transmission line;

(b) a first relay unit operably engaged to the first end of said donor unit; and (c) a second relay unit operably engaged to the second end of said donor unit.

5. The modular blasting system of claim 4 wherein said first relay unit is further operably engaged with at least one additional donor unit.

6. The modular blasting system of claim 4 wherein said second relay unit is further operably engaged with at least one additional donor unit.

7. A modular blasting system for use in blasting operations comprising:

(a) a donor unit comprising:

(i) a transmission line with a first end and a second end; and (ii) a donor mini-cap attached to each end of said transmission line;

(b) a first detonator unit operably engaged with said first end of said donor unit; and (c) a second detonator unit operably engaged with said second end of a said donor unit.

8. The modular system of claim 7 wherein said first detonator unit is further operably engaged with a relay unit.

9. The modular system of claim 7 wherein said second detonator unit is further operably engaged with a relay unit.

10. A method of constructing a modular blasting system using at least one donor unit having a first donor mini-cap attached to a second donor mini-cap by a signal transmission line comprising:

(a) choosing modular components having a desired signal transmission delay period;

(b) attaching the donor unit to an initiation source;

(c) attaching at least one of the donor mini-caps of said donor unit in operable engagement with a relay unit;

(d) engaging at least one additional donor unit to the body of said relay unit; and (e) engaging additional modular units to at least one of the donor mini-caps of said additional donor unit.

11. A method of constructing a modular blasting system comprising:

(a) choosing a donor unit with a length of signal transmission line between a first end and a second end, with a first donor mini-cap attached to said first end, and a second donor mini-cap attached to said second end;

(b) operatively engaging the length of signal transmission line of said donor unit to an initiation source; and (c) operatively engaging the first donor mini-cap to a first detonator.

12. The method of claim 11 further comprises:

(d) operatively engaging the second donor mini-cap to a second detonator.

13. The method of claim 11 further comprises:

(d) operatively engaging the second donor mini-cap to a second relay unit.

14. The method of claim 11 further comprises:

(d) operatively engaging the first detonator to a first relay unit.

15. The method of claim 14 further comprises:

(e) operatively engaging a second donor unit's length of signal transmission line to said first relay unit.

16. The method of claim 12 further comprises:

(e) operatively engaging a first relay unit to said first detonator.

17. The method of claim 16 further comprises:

(f) operatively engaging a second relay unit to said second detonator.

18. The method of claim 16 further comprises:

(f) operatively engaging a second donor unit's length of signal transmission line to said first relay unit.

19. A method of constructing a modular blasting system comprising:

(a) choosing a donor unit with a length of signal transmission line between a first end and a second end, with a first donor mini-cap attached to said first end, and a second donor mini-cap attached to said second end;

(b) operatively engaging the length of signal transmission line of said donor unit to an initiation source;

(c) operatively engaging a first relay unit to the first donor mini-cap; and (d) operatively engaging a second relay unit to the second donor mini-cap.

20. The method of claim 19 further comprises:

(e) operatively engaging a second donor unit's length of signal transmission line to said first relay unit.

* * * * *